US006423919B1

(12) United States Patent
Liao et al.

(10) Patent No.: US 6,423,919 B1
(45) Date of Patent: Jul. 23, 2002

(54) MECHANISM FOR SWITCHING A PULL SWITCH FOR LIGHTING FIXTURES

(76) Inventors: Sheng-Huei Liao; Shu Fang Lee, both of PO Box 82-144, Taipei (TW)

( * ) Notice: Subject to any disclaimer, the term of this patent is extended or adjusted under 35 U.S.C. 154(b) by 0 days.

(21) Appl. No.: 09/853,719

(22) Filed: May 14, 2001

(51) Int. Cl.[7] ..... H01H 3/20

(52) U.S. Cl. ..... 200/543; 200/330; 200/331

(58) Field of Search ..... 200/537, 538, 200/543, 329, 330, 331; 362/95, 147, 150, 253, 394, 395, 399, 400, 404, 457

(56) References Cited

U.S. PATENT DOCUMENTS 1,691,137 A * 11/1928 Schuchert ..... 362/132
2,014,217 A * 9/1935 Williamson ..... 200/330
2,598,310 A * 5/1952 Schaser ..... 200/331
5,339,618 A * 8/1994 Sawyer ..... 362/404
5,878,871 A * 3/1999 Miesner ..... 200/330
5,993,159 A * 11/1999 Mack ..... 200/331

* cited by examiner

*Primary Examiner*—Michael Friedhofer
(74) *Attorney, Agent, or Firm*—Leong C. Lei

(57) ABSTRACT

A mechanism for switching a pull switch for a lighting fixture having having a vertical post, a socket mounted at an upper end of the vertical post, and a pull switch fitted within the socket, the switch being operatively connected with a mechanism, characterized in that the mechanism comprises a fixing seat mounted under the socket, the fixing seat having a center opening for passage of the vertical post, a driving member having a first end pivotally connected with the fixing seat, a string connecting the pull switch and a second end of the driving member, and a rod having an upper end connected with an intermediate portion of the driving member.

5 Claims, 5 Drawing Sheets

MECHANISM FOR SWITCHING A PULL SWITCH FOR LIGHTING FIXTURES

BACKGROUND OF THE INVENTION

1. Field of the Invention

This invention is related to a mechanism for switching a pull switch for lighting fixtures and in particular to one which can be easily operated to turn on or off a lighting fixture as required.

2. Description of the Prior Art

Referring to FIG. 5, the conventional lamp with a pull switch generally includes a base 61, a vertical post 62 vertically mounted on the base 61, a socket 63 arranged at the upper end of the vertical post 62, a bulb (not shown) engaged with the socket 63, a pull switch (not shown) mounted in the socket 63, and a string 44 having an upper end extending through a connector 65 to engage with the pull switch. The string 44 is suspended from the connection 65 so that the string 64 is disposed in parallel with the vertical post 62. The lower end of the string 44 is provided with a decoration member 66 for keeping the string 44 at a fixed position when it is not subject to external forces. When desired to turn on or off a lighting fixture, it is only necessary to pull down the string 44 to control the pull switch. However, such an operation still suffers from the following drawbacks:

1. The distance between the string 64 and the vertical post 62 is small and the string 64 cannot be kept at a fixed position so that when one wants to grasp the string 64 to operate the pull switch, one's hand will be often in collision with the vertical post 62 and it often takes several times to catch the string 64 thereby causing much inconvenience in operation.
2. The string 64 will move to and fro after being pulled to switch the pull switch, so that the decoration member 66 mounted at the lower end of the string 64 will hit the vertical post 62 to produce undesirable noise.
3. The string 64 will often slip out of one's hand so that one often has to try several times to hold the string.

Therefore, it is an object of the present invention to provide a mechanism for switching a pull switch for light fixtures which can obviate and mitigate the above-mentioned drawbacks.

SUMMARY OF THE INVENTION

This invention is related to a mechanism for switching a pull switch for a lighting fixture.

It is the primary object of the present invention to provide a mechanism for switching a pull switch for a lighting fixture which can be easily operated to turn on or off a lighting fixture.

It is another object of the present invention to provide a mechanism for switching a pull switch for a lighting fixture which is simple in construction.

It is a further object of the present invention to provide a mechanism for switching a pull switch for a lighting fixture which is low in cost and easy to assemble.

According to a preferred embodiment of the present invention, a mechanism for switching a pull switch for a lighting fixture having having a vertical post, a socket mounted at an upper end of the vertical post, and a pull switch fitted within the socket, the switch being operatively connected with a mechanism, characterized in that the mechanism comprises a fixing seat mounted under the socket, the fixing seat having a center opening for passage of the vertical post, a driving member having a first end pivotally connected with the fixing seat, a string connecting the pull switch and a second end of the driving member, and a rod having an upper end connected with an intermediate portion of the driving member.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
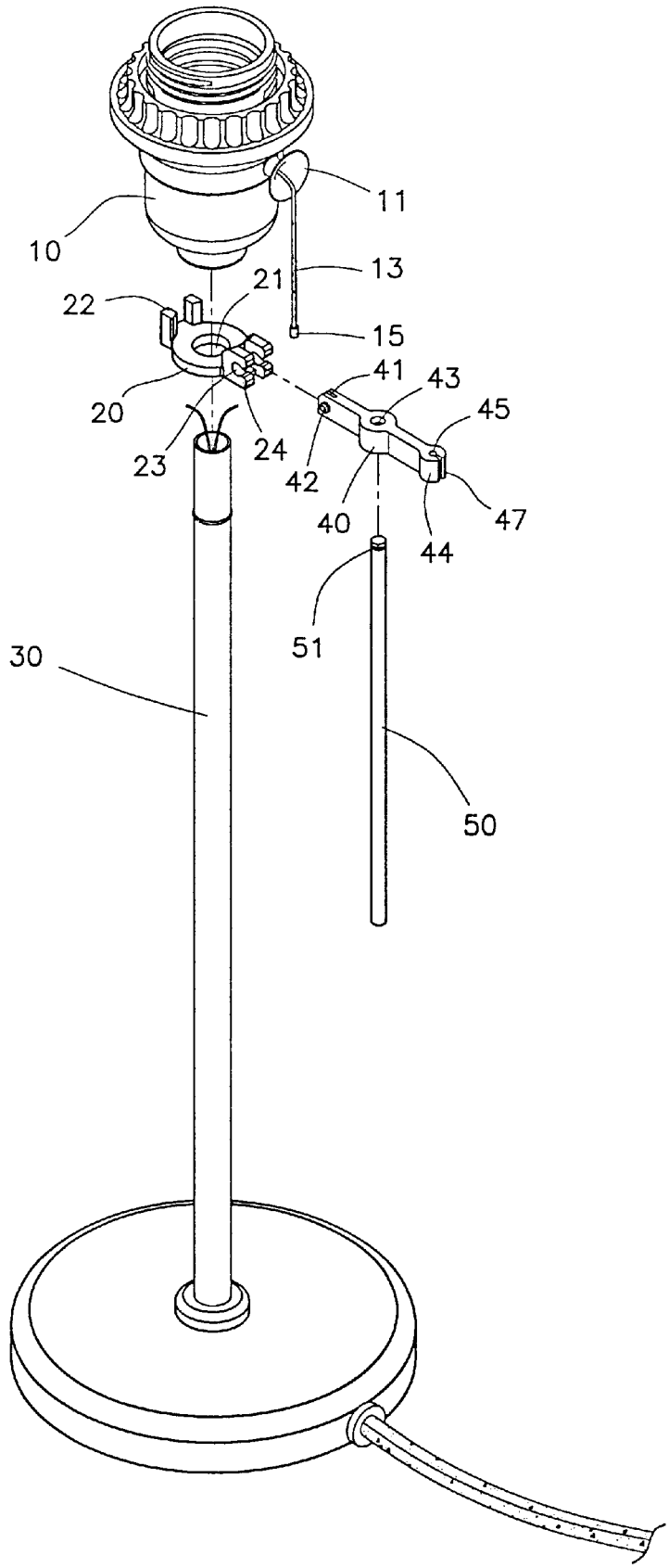
FIG. 1 is an exploded view of the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, alterations and further modifications in the illustrated device, and further applications of the principles of the invention as illustrated herein being contemplated as would normally occur to one skilled in the art to which the invention relates.

Figure 2:
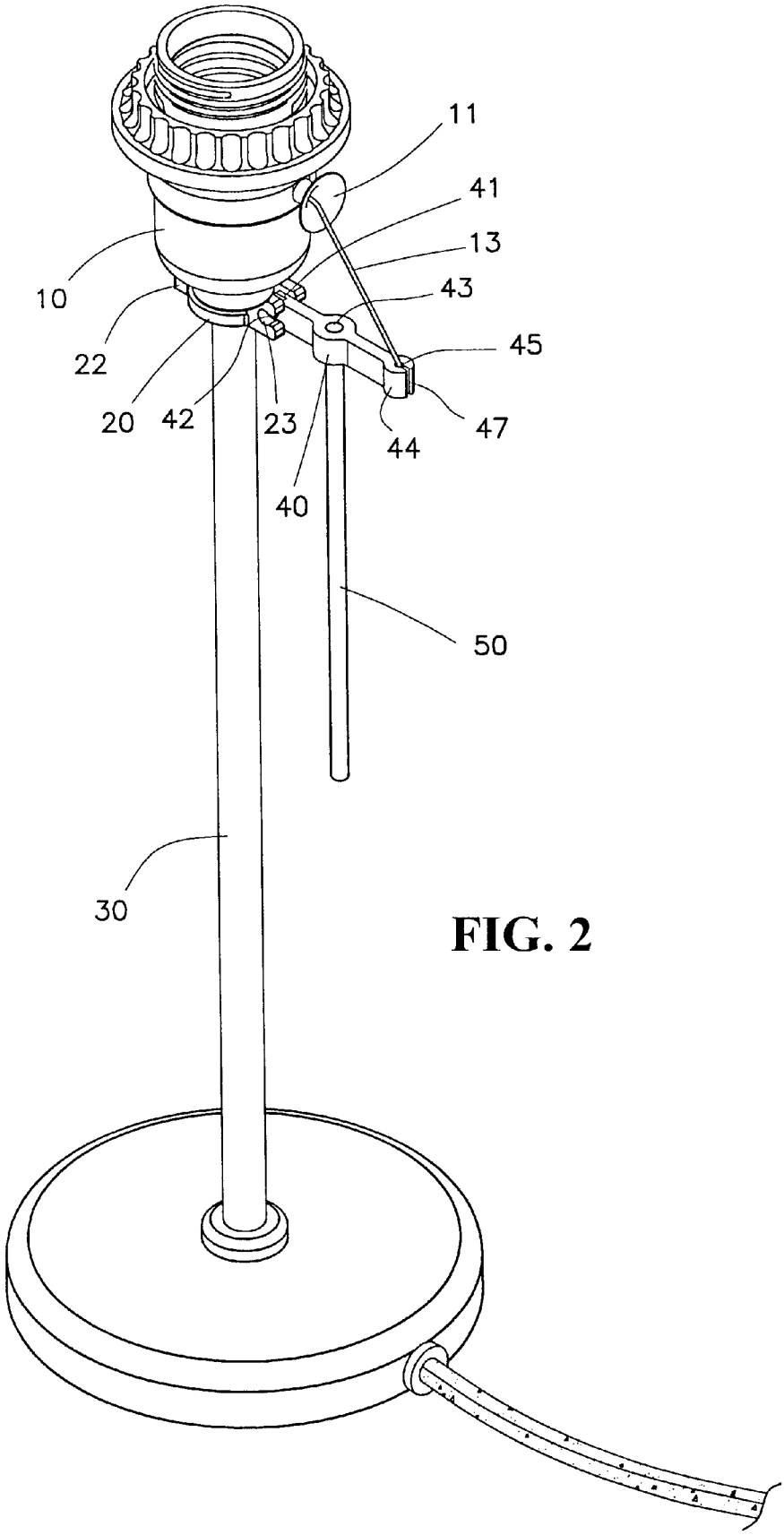
FIG. 2 is a perspective view of the present invention.
Figure 3:
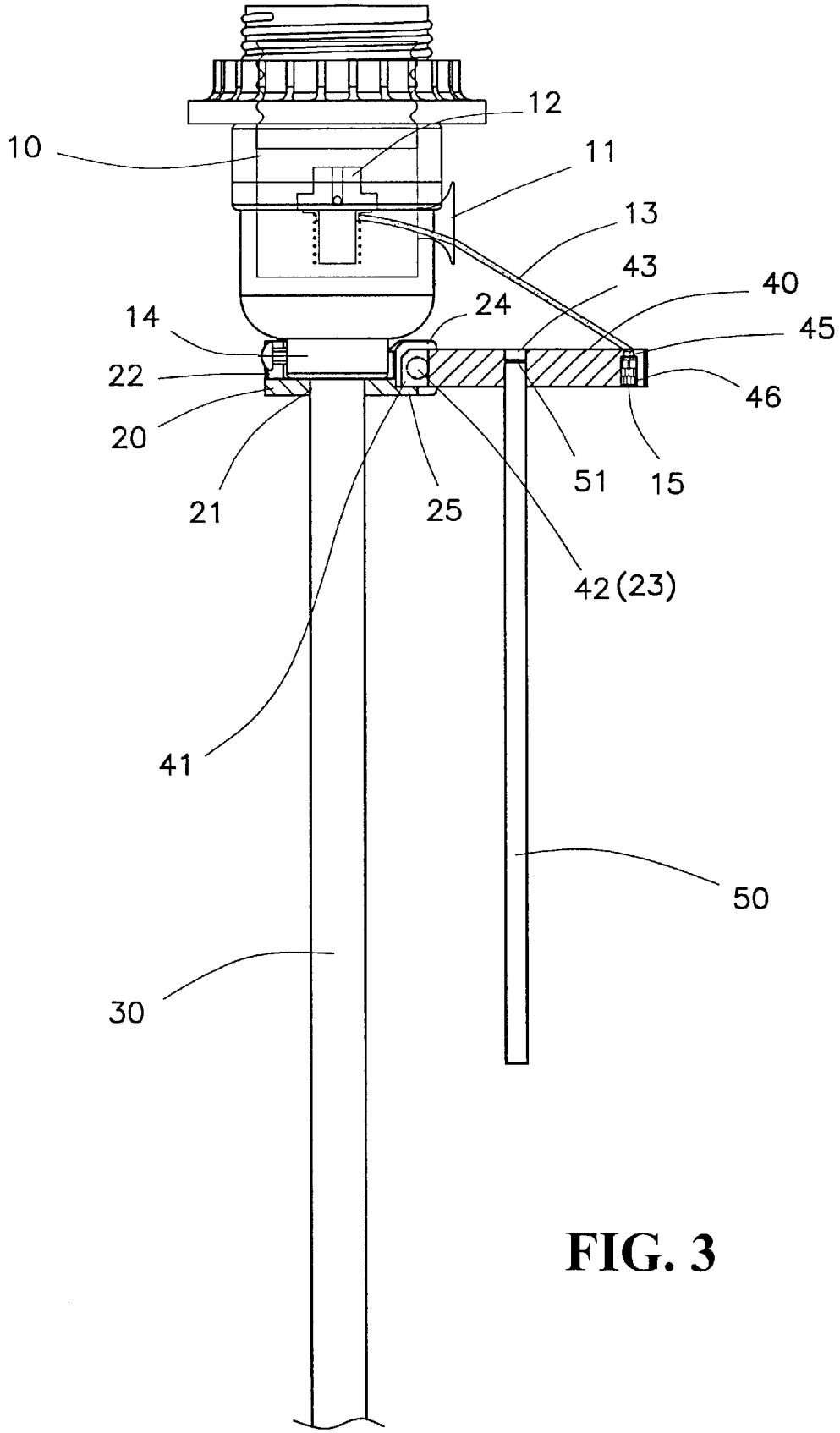
FIG. 3 is a sectional view of the present invention.

With reference to the drawings and in particular to FIGS. 1, 2 and 3 thereof, a lamp comprises a socket 10 provided with a tubular connector 11 for the passage of a string 13. An end of the string 13 extends through the tubular connector 11 to engage with a pull switch 12. The pull switch 12 is well known in art and has no need to be described here in detail.

The present invention is characterized as follows:

A fixing seat 20 is mounted under the socket 10 and has a center opening 21 for the passage of a vertical post 30 of a lamp. The fixing seat 20 is provided with a pair of upwardly extending arms 22 at one end, and a pair of lugs 24 at the other end. The fixing seat 20 is fixedly secured to the bottom of the socket 10 by a screw 13 (see FIG. 3). The lugs 24 are each formed with an open slot 23.

A driving member 40 is provided at an end with an axle 42 which is fitted into the open slot 23 of the lugs 24 of the fixing seat 20, so that the driving member 40 is pivotally connected with the fixing seat 20. The driving member 40 has a vertical through hole 43 at the central portion and a stepped hole at the other end. The stepped hole includes a small hole 45 at the upper position and a large hole 46 at the lower position. The stepped hole has a vertical slit 47 which is dimensioned for the passage of a string 13. The string 13 has a lower end provided with a head member 14 which is configured and dimensioned to fit into the large hole 46 of the driving member 40 from the bottom of the stepped hole.

A rod 50 has an upper end 51 which is force-fitted into the vertical through hole 43 of the driving member 40 so that the driving member 40 will be moved in unison with the rod 50. However, if the driving member 40 is made by injection molding, the upper end of the rod 51 may be enclosed by the central portion of the driving member 40.

Figure 4:
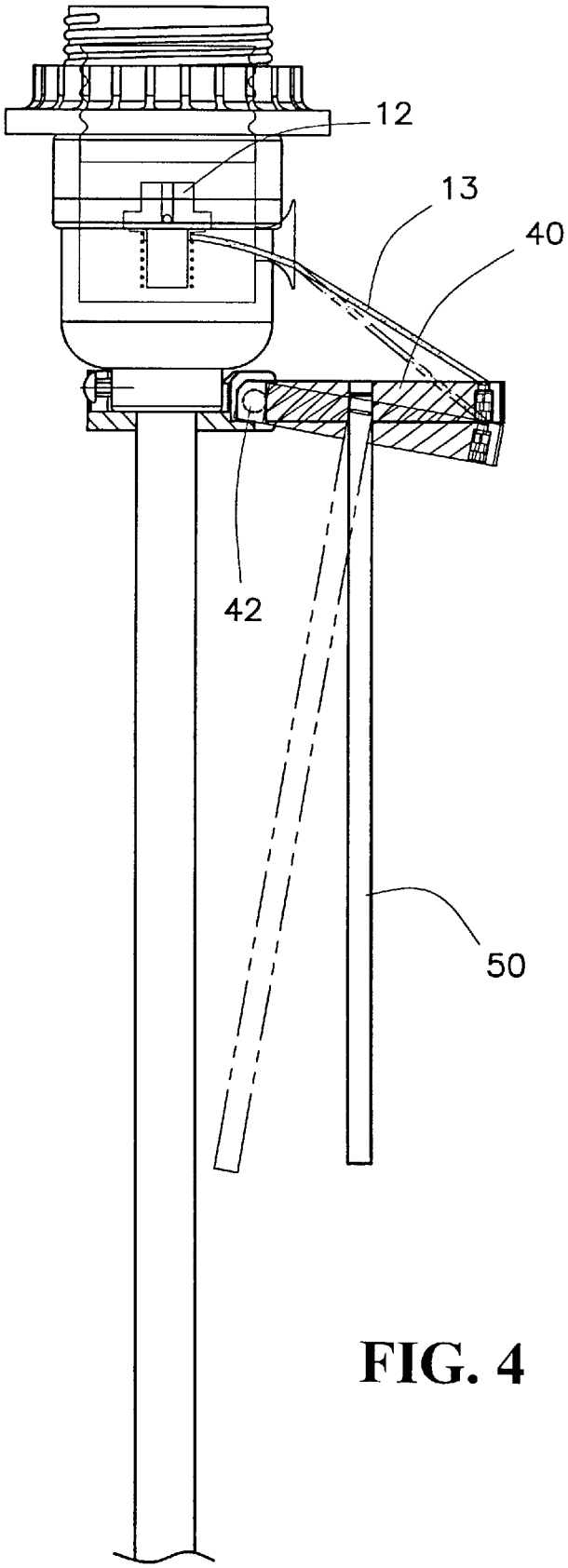
FIG. 4 illustrates the operation of the present invention.
Figure 5:
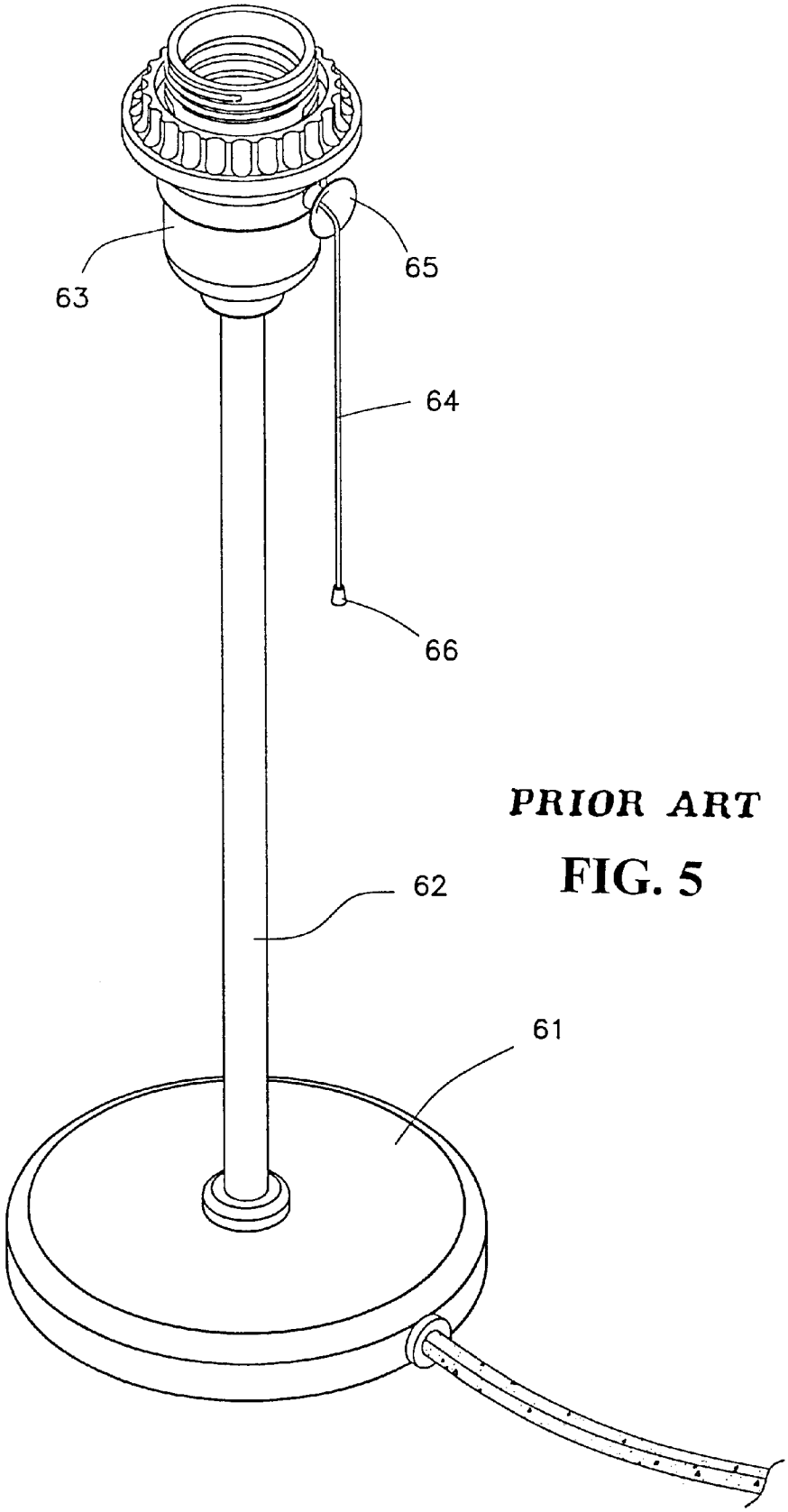
PRIOR ART FIG. 5
FIG. 5 is a perspective view of a lamp with a string for operating a pull switch.

As shown in FIGS. 3 and 4, when desired to turn on or off the lighting fixture, it is only necessary to move the rod 50 against the vertical post 30 of the lamp so that the driving member 40 will be rotated downwardly with respect to the fixing seat 40 thereby pulling down the string 13 to actuate the pull switch 12. As the rod 50 is released, the pull switch 12 will pull back the string 13 thereby returning the driving member 40 and the rod 50 to their original positions.

In conclusion, the present invention has the following advantages:

1. The lamp 10 can be easily turned on or off simply by applying a slight force to move the rod 10 thereby making easier the operation.
2. The present invention is simple in construction, low in cost and easy to assemble.
3. The present invention utilizes a rod instead of a string to operate the switching a lamp thereby making it easier to control.
4. The rod 50 will not sway to and fro so that a user may hold the rod without any difficulty.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

We claim:

1. In a lighting fixture having a vertical post, a socket mounted at an upper end of said vertical post, and a pull switch fitted within said socket, said switch being operatively connected with a mechanism, wherein said mechanism comprises a fixing seat mounted under said socket, said fixing seat having a center opening for passage of said vertical post, a driving member having a first end pivotally connected with said fixing seat, a string connecting said pull switch and a second end of said driving member, and a rod having an upper end connected with an intermediate portion of said driving member.

2. The mechanism as claimed in claim 1, wherein said fixing seat is provided with a pair of upwardly extending arms at an end thereof, and a pair of lugs at another end thereof, said fixing seat being fixedly secured to a bottom of said socket by a screw.

3. The mechanism as claimed in claim 2, wherein said lugs are each formed with an open slot for receiving said first end of said driving member.

4. The mechanism as claimed in claim 3, wherein said first end of said driving member is provided with an axle pivotally connected with said open slot of said lugs.

5. The mechanism as claimed in claim 1, wherein said second end of said driving member has a stepped hole which includes a first hole and a second hole which is located under said first hole and larger than said first hole, said stepped hole having a vertical slit which is dimensioned for passage of said string, said second hole being dimensioned to receive a head member attached to a lower end of said string.

* * * * *